US009271550B2

(12) United States Patent
Xiong

(10) Patent No.: US 9,271,550 B2
(45) Date of Patent: Mar. 1, 2016

(54) ADJUSTABLE UMBRELLA

(71) Applicant: Phaeton Manufacturing LLC, Rudong Town (CN)

(72) Inventor: Luo Xiong, Rudong Town (CN)

(73) Assignee: Phaeton Manufacturing LLC, Rudong Town (CN)

( * ) Notice: Subject to any disclaimer, the term of this patent is extended or adjusted under 35 U.S.C. 154(b) by 134 days.

(21) Appl. No.: 14/223,688

(22) Filed: Mar. 24, 2014

(65) Prior Publication Data

US 2015/0059815 A1 Mar. 5, 2015

(30) Foreign Application Priority Data

Sep. 2, 2013 (CN) ..... 2013 2 0541314 U

(51) Int. Cl.
*A45B 17/00* (2006.01)
*A45B 23/00* (2006.01)

(52) U.S. Cl.
CPC ..... *A45B 17/00* (2013.01); *A45B 23/00* (2013.01); *A45B 2023/005* (2013.01); *A45B 2023/0037* (2013.01)

(58) Field of Classification Search
CPC ..... A45B 17/00; A45B 2023/0031; A45B 2023/0037; A45B 2023/005; A45B 2023/0075; A45B 2023/0081
See application file for complete search history.

(56) References Cited

U.S. PATENT DOCUMENTS

| | | | | |
|---|---|---|---|---|
| 6,588,438 | B1 * | 7/2003 | Steiner | A45B 23/00 135/20.1 |
| 6,840,253 | B2 * | 1/2005 | Ma | A45B 17/00 135/155 |
| 7,156,114 | B2 * | 1/2007 | Lo | A45B 23/00 135/20.1 |
| 7,398,790 | B2 * | 7/2008 | Glatz | A45B 23/00 135/20.1 |
| 7,493,909 | B2 * | 2/2009 | Ma | A45B 23/00 135/20.1 |
| 7,533,680 | B2 * | 5/2009 | Ma | A45B 17/00 135/20.1 |
| 7,708,022 | B2 * | 5/2010 | Joen-an Ma | A45B 23/00 135/20.1 |
| 7,717,121 | B2 * | 5/2010 | Glatz | A45B 23/00 135/20.1 |
| 8,985,129 | B2 * | 3/2015 | Li | A45B 17/00 135/20.1 |
| 2014/0230867 | A1 * | 8/2014 | Ma | A45B 11/00 135/20.1 |
| 2014/0311537 | A1 * | 10/2014 | Ma | A45B 17/00 135/20.1 |

* cited by examiner

*Primary Examiner* — David R Dunn
*Assistant Examiner* — Danielle Jackson
(74) *Attorney, Agent, or Firm* — Wang Law Firm, Inc.

(57) ABSTRACT

An adjustable umbrella, which includes: an umbrella base, a stand column, a sliding sleeve, a cross rod, an umbrella cover adjustment mechanism, a drawing rod, and an umbrella frame, wherein a top of the umbrella frame is rotatably attached to a top end of the cross rod through a rotating mechanism, a bottom joint of the cross rod is rotatably connected to the sliding sleeve, the umbrella frame has an elongated umbrella rib with a bottom end, the bottom end of the elongated umbrella rib is connected to the umbrella cover adjustment mechanism, the umbrella frame is rotatable by adjusting the umbrella cover adjustment mechanism. The sunshade is novel in appearance, and has strong practical performance and reasonable and practical structure.

9 Claims, 7 Drawing Sheets

ADJUSTABLE UMBRELLA

RELATE APPLICATIONS

This application claims the benefit of Chinese Utility Model Application 201320541314.3, filed on Sep. 2, 2013, the specification of which is incorporated herein by this reference.

FIELD OF THE INVENTION

The invention relates to the technical field of an outdoor sunshade, particularly to an adjustable umbrella capable of adjusting a shading angle.

DESCRIPTION OF THE PRIOR ART

As a tool for outdoor leisure, a sunshade is widely applied to squares, beaches, parks, courtyards and other leisure places, in order to provide comfortable shaded space for people.

The position of the umbrella cover of an existing sunshade is generally fixed and can not be adjustable. However, if the angle of an umbrella cover may be adjusted and changed along with the change of wind direction and the inclination of sunlight, better shading and wind-shielding effects can be achieved. To meet the requirement, there also are sunshades with an adjustable umbrella cover. For example, a Chinese Patent CN202552458U (Patent No.: 201220168486.6), titled Umbrella Cover Adjustment Mechanism of Sunshade, comprises a shell which is sleeved on a curved arm of the sunshade and connected to a stand column and a large curved arm, the top end of the stand column is connected to the bottom end of the large curved arm via the shell, wherein a groove is provided on a convolution surface of the large curved arm in a length direction, a synchronous belt is disposed in the recess, a plug pin assembly engaged the teeth on the synchronous belt is disposed at the inside middle position of the curved arm, one end of the plug pin assembly is connected to a spanner via a wire rope, so that the plug pin assembly is driven to separate from the synchronous belt by the spanner so as to adjust the curved arm. This adjustment way realizes the adjustment of the umbrella cover by adjusting the curved arm, and is complicated in structure, troublesome in manufacturing, high in cost and inconvenient in operation.

SUMMARY OF THE INVENTION

It is an object of the present invention to provide an adjustable umbrella with a simple structure, a convenient operation and a low manufacturing cost.

For achieving this object, the adjustable umbrella, comprises: an umbrella base; a stand column fixed on the umbrella base, the stand column having a top; a sliding sleeve slidably connected to the stand column; a cross rod, movably connected to the sliding sleeve and slidable relative to the stand column, having a bottom end, a top end, and a bottom joint, the bottom joint being disposed on the bottom end of the cross rod; an umbrella cover adjustment mechanism provided between the bottom joint and the bottom end of the cross rod; a drawing rod having a first end and a second end, the first end of the drawing rod rotatably disposed on the top of the stand column, the second end of the drawing rod rotatably connected to the cross rod; and an umbrella frame with a top, wherein the top of the umbrella frame is rotatably attached to the top end of the cross rod through a rotating mechanism, the bottom joint of the cross rod is rotatably connected to the sliding sleeve, the umbrella frame has an elongated umbrella rib with a bottom end, the bottom end of the elongated umbrella rib is connected to the umbrella cover adjustment mechanism, the umbrella frame is rotatable by adjusting the umbrella cover adjustment mechanism.

Preferably, the umbrella cover adjustment mechanism comprises a clutch toothed sleeve, a handle, and a first pin, the clutch toothed sleeve has an extension portion and an inner wall with a first annular recess, and a first pin has two ends; the clutch toothed sleeve is rotatably sleeved on outside of the lower portion of the cross rod and is limited in position by the handle, the first pin transversely passes through the cross rod and the two ends of the first pin are inserted into the first annular recess on the inner wall of the clutch toothed sleeve to position the clutch toothed sleeve relative to the cross rod; a connecting hole is provided on the extension portion of the clutch toothed sleeve for receiving the bottom end of the elongated umbrella rib, and a protective jacket with a inserting hole for receiving the bottom end of the elongated umbrella rib when the elongated umbrella rib is inserted into the connecting hole.

Preferably, the handle has an inner wall and slidably sleeves outside of the cross rod between the bottom end of the cross rod and the clutch toothed sleeve, at least one second pin transversely passes through the cross rod to limit movement of the handle, two circular grooves are formed on the inner wall of the handle for the two ends of the at least one second pin to insert in; the clutch toothed sleeve and the handle each has an interface surface and both interface surfaces are provided with matching looped teeth; a spring is disposed between the at least one second pin and a step formed on the inner wall of the handle adjacent to the clutch toothed sleeve, the spring is able to move the handle to engage the clutch toothed sleeve.

Preferably, the rotating mechanism comprises a connection sleeve, a hinge, and a top joint, the hinge has a bottom, the top joint has a first end and a second end and is disposed on the top end of the cross rod, the connection sleeve is inserted into the top end of the cross rod, the first end of the top joint is rotatably inserted in the connection sleeve, the second end of the top joint is attached to the hinge, and the bottom of the hinge is connected to the top of the umbrella frame.

Preferably, the connection sleeve has an external surface and two ends, the connection sleeve is provided with a second annular recess on the external surface, the two ends of the connection sleeve is provided with a plurality of small holes, a plurality of rivets transversely pass through the top end of the cross rod and insert into the small holes of the connection sleeve to fix the connection sleeve to the cross rod, one end of the connection sleeve is leveled with the top end of the cross rod after assembled.

Preferably, the first end of the top joint is a circular tube for engaging the second annular recess of the connection sleeve, a flange edge and a limiting ring are respectively formed at the two ends of the circular tube of the top joint, and the flange edge resists against an annular surface on an inner wall of the connection sleeve, while the limiting ring resists against an outer surface of the top end of the cross rod, the second end of the top joint is provided with a mounting hole for mounting to the hinge.

Preferably, the connection sleeve is composed of a pair of semicircle pieces, each semicircle piece is mounted in the cross rod by two rivets.

Preferably, the umbrella frame has a cylinder on the top, the cylinder is inserted into the hinge and fixed to the hinge by screws.

Preferably, the bottom joint is connected to the sliding sleeve and to the bottom end of the cross rod by rivets.

Preferably, a top cover is provided on the top of the stand column, a connection piece sleeves outside of the cross rod for connecting the drawing rod, the first end and a second end of the drawing rod respectively are connected to the top cover and to the connection piece.

Compared with the prior art, in the present invention, the top of the umbrella frame is connected to the rotating mechanism on the top of the cross rod, the bottom end of the elongated umbrella rib of the umbrella frame is connected to the umbrella cover adjustment mechanism on the bottom end of the cross rod, and when in use, the rotation of the clutch toothed sleeve drives the rotation of the umbrella frame to perform the object of adjusting a shading angle. The present invention not only has simple structure, convenient manufacturing, low cost and easy operation, but also can adjust the shading angle in a stepless manner. In addition, the sunshade disclosed by the present invention is novel in appearance, and has strong practical performance and reasonable and practical structure.

DETAILED DESCRIPTION OF THE PREFERRED EMBODIMENT

Figure 1:
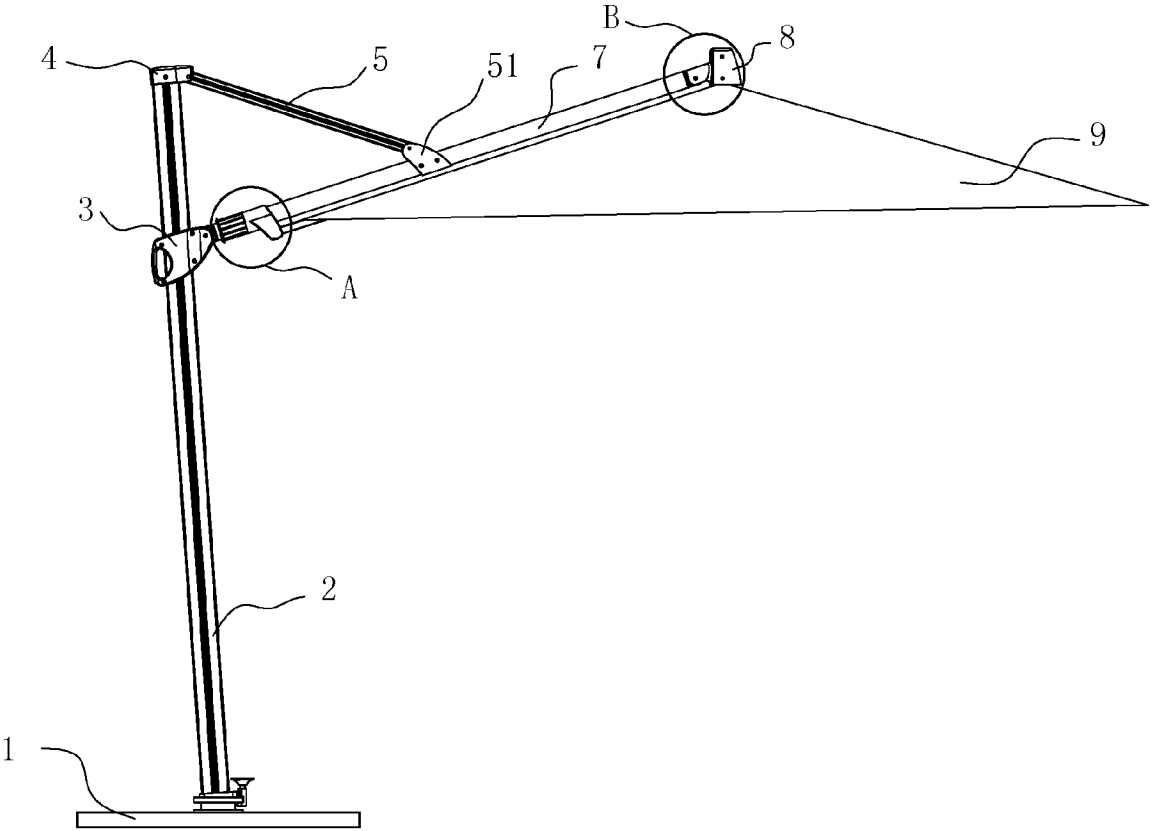
FIG. 1 is a view of an adjustable umbrella in accordance with an embodiment of the present invention.
Figure 2:
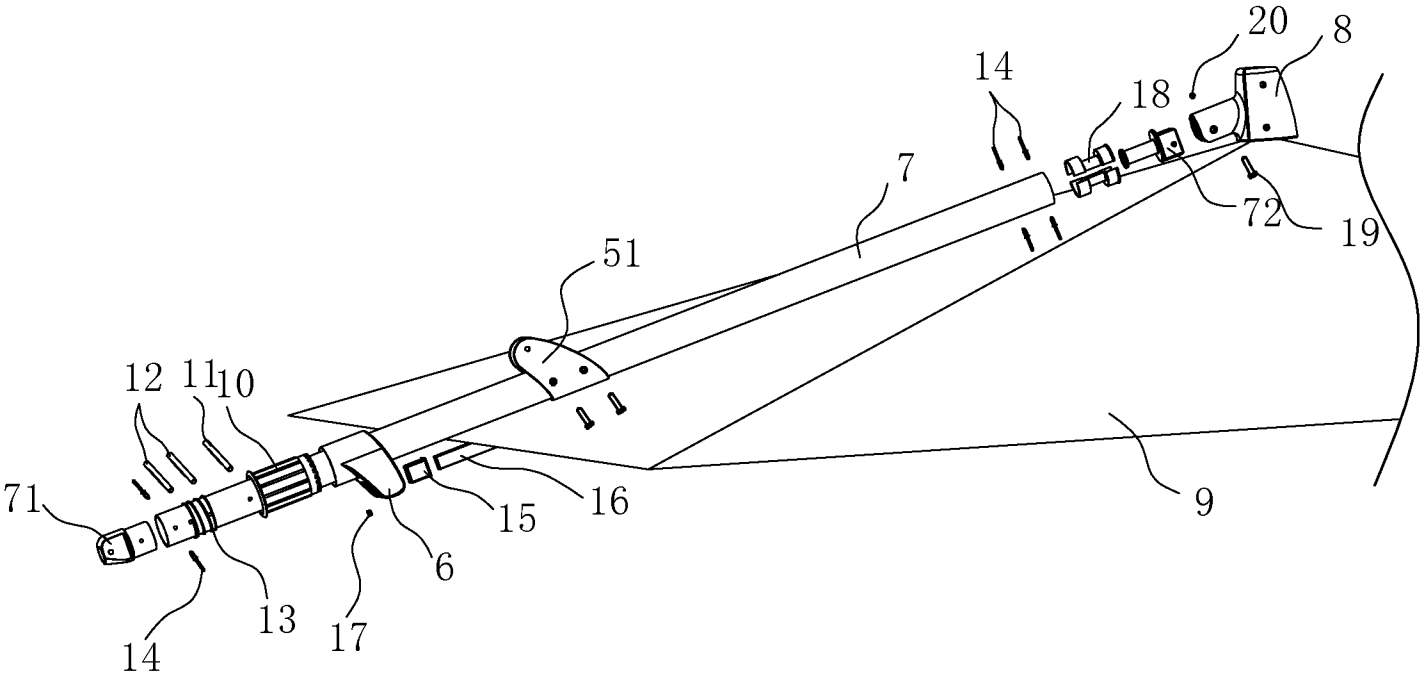
FIG. 2 is an exploded view of the cross rod and the umbrella frame in FIG. 1.
Figure 3:
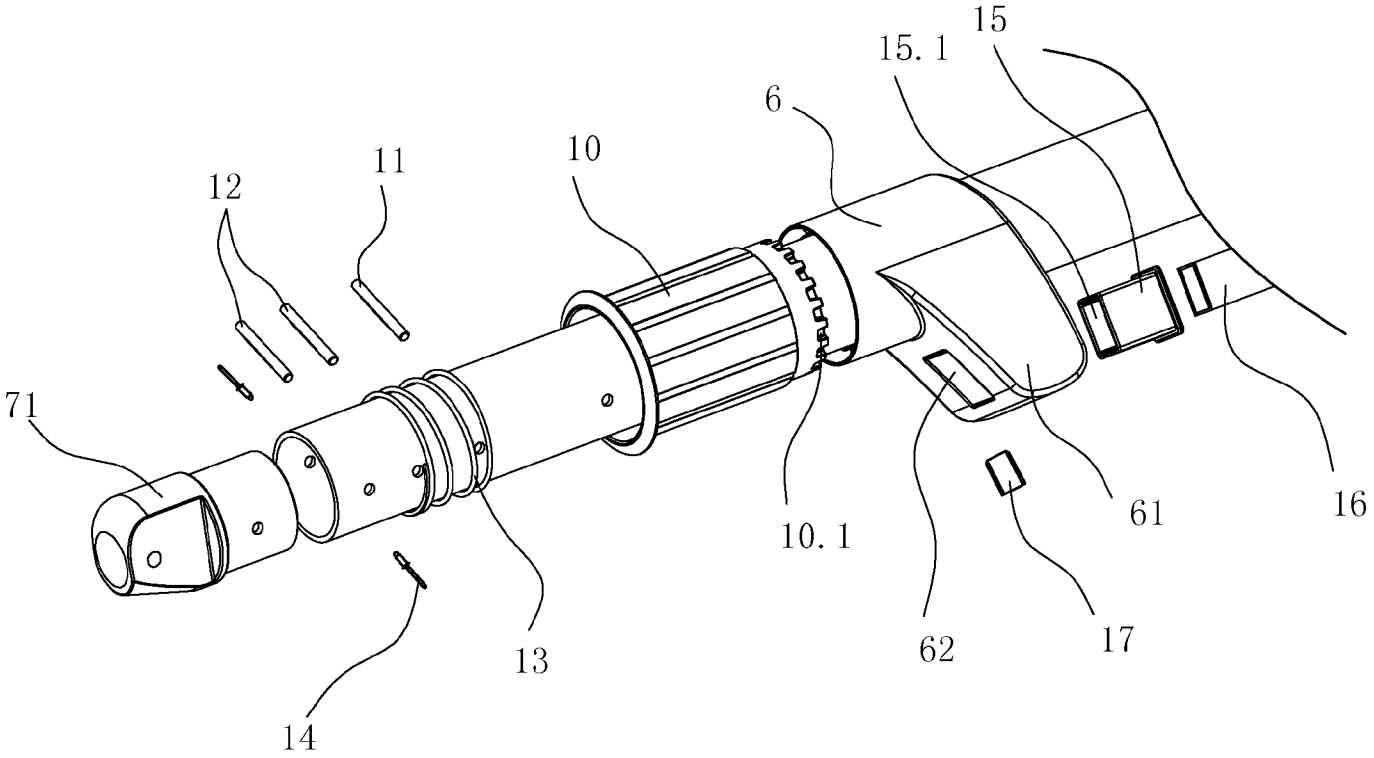
FIG. 3 is a partial enlarged view of region-A in FIG. 1.
Figure 4:
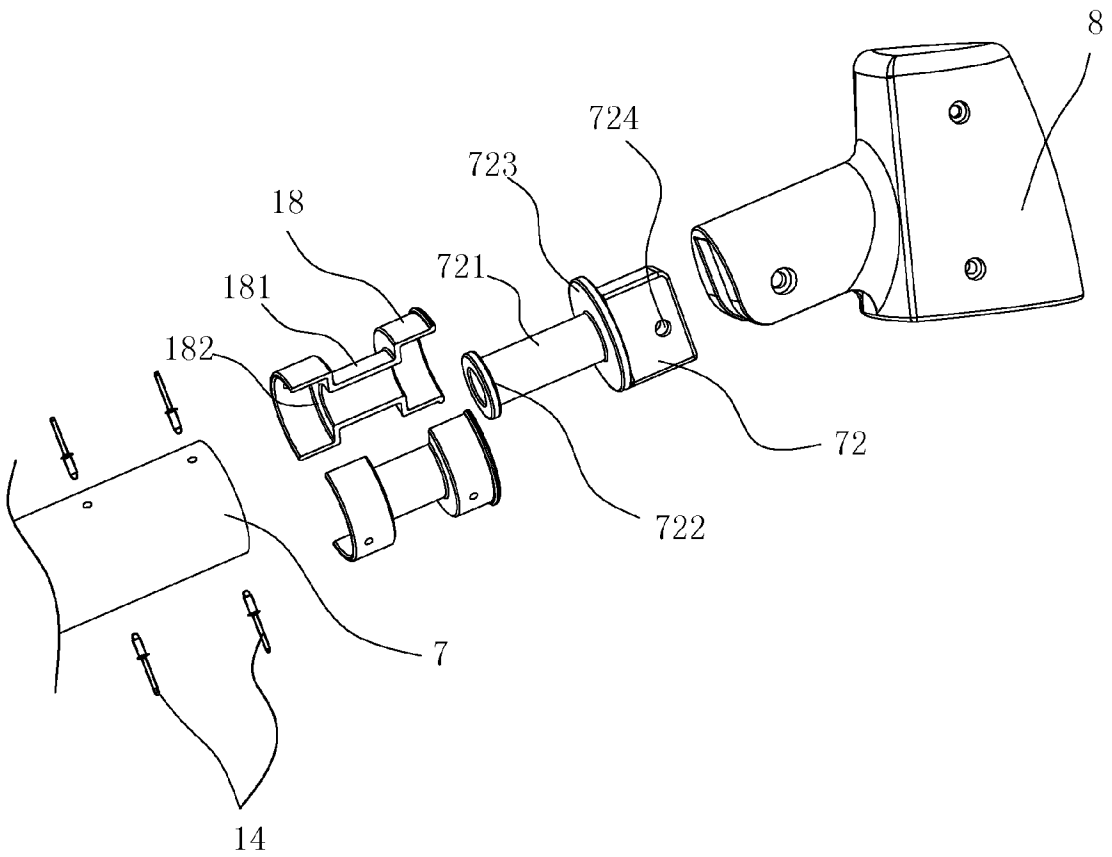
FIG. 4 is a partial enlarged view of region-B in FIG. 1.
Figure 5:
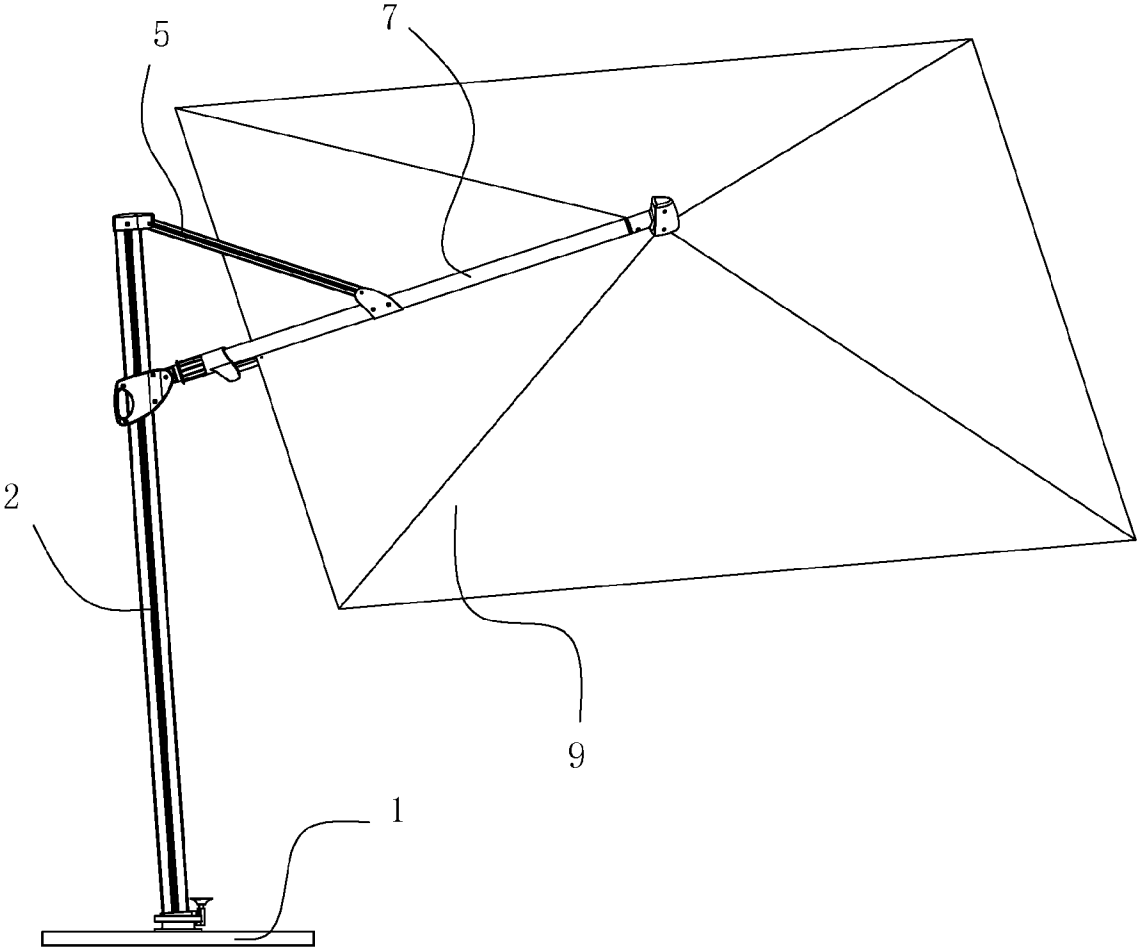
FIG. 5 is a view of the adjustable umbrella in accordance with the embodiment of the present invention when the shading angle is adjusted in a stepless manner.
Figure 6:
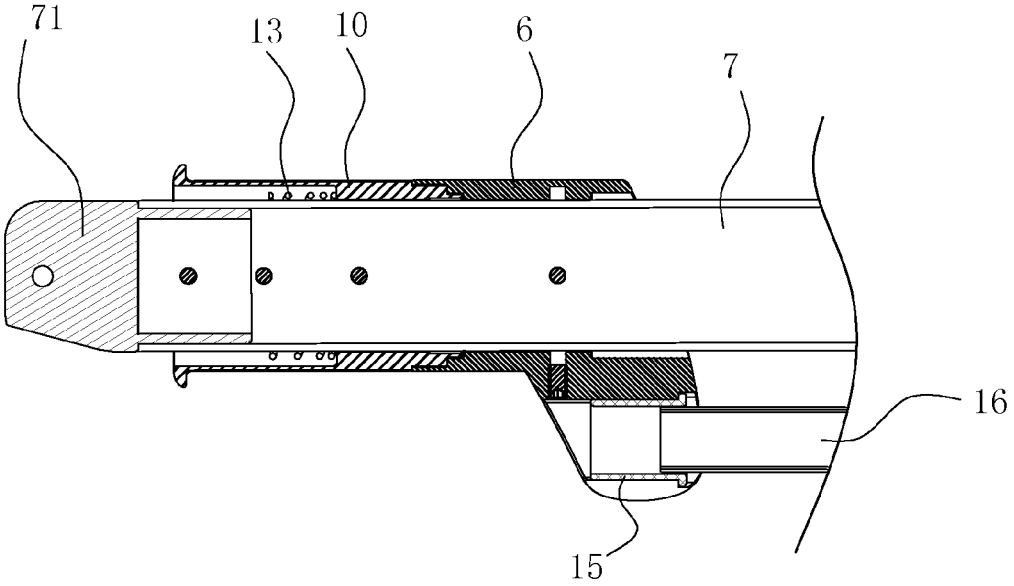
FIG. 6 is a longitudinal sectional view of region-A in FIG. 1.
Figure 7:
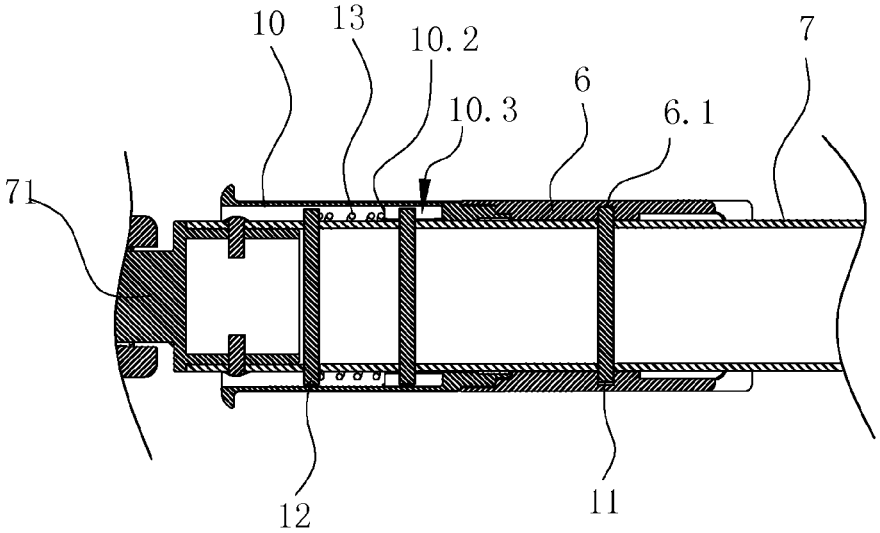
FIG. 7 is a horizontal sectional view of region-A in FIG. 1.
Figure 8:
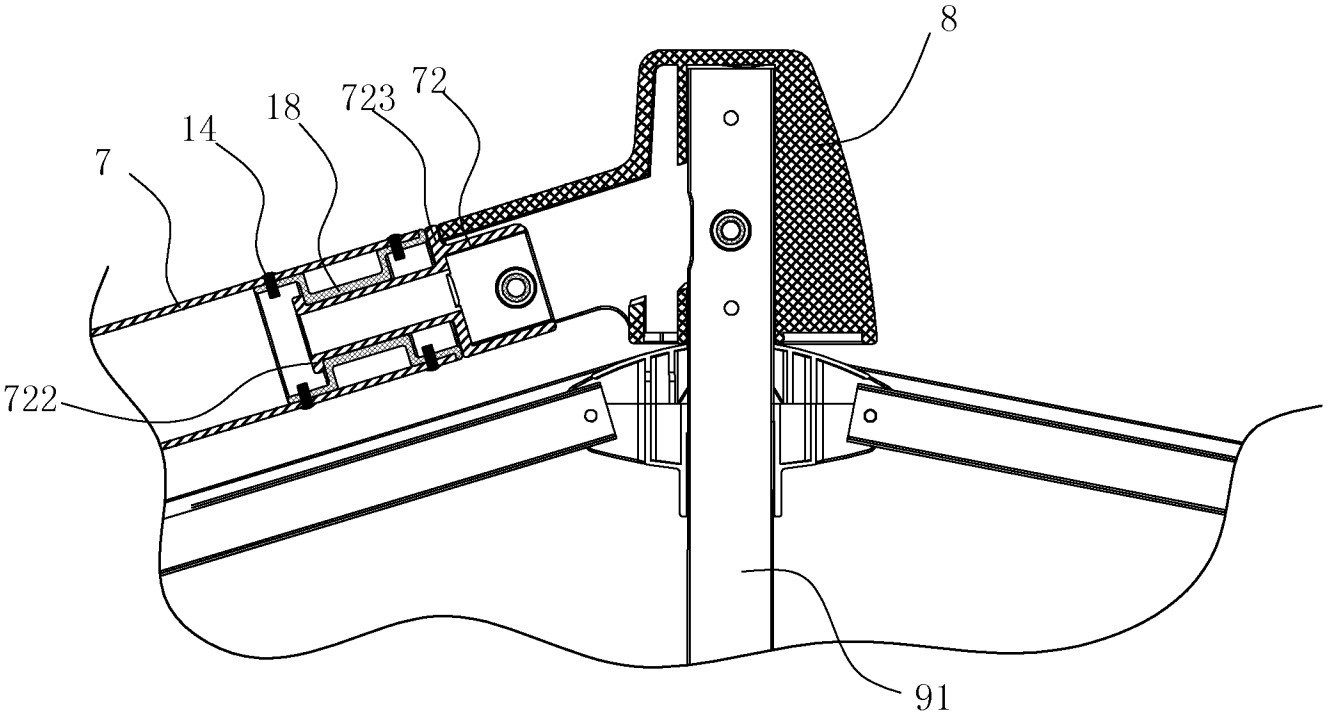
FIG. 8 is a longitudinal sectional view of region-B in FIG. 1.

To enable a further understanding of the innovative and technological content of the invention herein, refer to the detailed description of the invention and the accompanying drawings below:

As shown in FIG. 1 to FIG. 7, in this embodiment, an adjustable umbrella comprises an umbrella base 1, a stand column 2, a cross rod 7, a drawing rod 5 and an umbrella frame 9, the stand column 2 is fixed on the umbrella base 1, the top of the umbrella frame 9 is rotatably attached to the top end of the cross rod 7 through a rotating mechanism, the bottom end of the cross rod 7 is connected to a sliding base 3 slidably connected to the stand column 2, the sliding base 3 generally has a handheld handle, a top cover 4 is provided on the top of the stand column 2, a drawing rod has a first end and a second end, the first end and the second end of the drawing rod 5 respectively are rotatably connected to the top cover 4 and to the connection piece 51 sleeving outside of the cross rod 7 for connecting the drawing rod 5, so that the cross rod is fixed;

the cross rod 7 is a hollow circular tube, the cross rod 7 has a bottom joint 71, the bottom joint 71 disposed on the bottom end of the cross rod 7, is rotatably connected to the sliding base 3, an umbrella cover adjustment mechanism A being is provided between the bottom joint 71 and the bottom end of the cross rod 7, the umbrella frame 9 has an elongated umbrella rib 16 with a bottom end, the bottom end of the elongated umbrella rib 16 is connected to the umbrella cover adjustment mechanism A;

The umbrella cover adjustment mechanism A comprises a clutch toothed sleeve 6 and a handle 10, the clutch toothed sleeve 6 is rotatably sleeved on outside of the lower portion of the cross rod 7 and is limited in position by the handle 10, a first pin 11 having two ends transversely passes through the cross rod 7 and the two ends of the first pin 11 are inserted into a first annular recess 6.1 on the inner wall of the clutch toothed sleeve 6 to position the clutch toothed sleeve 6 relative to the cross rod, a pin insertion port is closed by a set screw 17 so that the clutch toothed sleeve 6 can only rotate around the cross rod 7 as an axis but not slide axially, the clutch toothed sleeve has an extension portion 61, a connecting hole 62 is provided on the extension portion 61 of the clutch toothed sleeve 6 for receiving the bottom end of the elongated umbrella rib 16, the elongated umbrella rib 16 is movably disposed in the umbrella frame 9, and a protective jacket 15 with a inserting hole 15.1 for receiving the bottom end of the elongated umbrella rib 16 when the elongated umbrella rib is inserted into the connecting hole 62, the inserting hole 15.1 has a same shape to the elongated umbrella rib 16; the handle 10 has an inner wall and slidably sleeves outside of the cross rod 7 between the bottom end of the cross rod 7 and the clutch toothed sleeve 6, two second pins 12 transversely pass through the cross rod 7 to limit movement of the handle 10, two circular grooves 10.3 are formed on the inner wall of the handle 10 for the two ends of the two second pins 12 to insert in, the fitting of the circular grooves 10.3 and the second pins 12 ensures that the handle 10 can only axially move along the cross rod 7, but not rotate around the cross rod 7, the clutch toothed sleeve 6 and the handle 10 each has an interface surface and both interface surfaces are provided with matching looped teeth; a spring 13 is disposed between the two second pins 12 and a step formed on the inner wall of the handle 10 adjacent to the clutch toothed sleeve 6, the spring is able to move the handle 10 to engage the clutch toothed sleeve 6;

a rotating mechanism B comprises a connection sleeve 18 and a hinge 8, the connection sleeve 18 having an external surface and two ends is composed of a pair of semicircle pieces, the connection sleeve is provided with a second annular recess 181 on the external surface, the two ends of the connection sleeve 18 is provided with a plurality of small holes, a plurality of rivets 14 transversely pass through the top end of the cross rod 7 and insert into the small holes of the connection sleeve 18 to fix the connection sleeve 18 to the top end of the cross rod 7, one end of the connection sleeve 18 is leveled with the top end of the cross rod 7 after assembled, the first end of the top joint 72 is rotatably inserted in the connection sleeve 18, the second end of the top joint 72 is attached to the hinge 8, and the bottom of the hinge 8 is connected to the top of the umbrella frame 9;

the first end of the top joint 72 is a circular tube for engaging the second annular recess 181 of the connection sleeve 18, a flange edge 722 and a limiting ring 723 are respectively formed at the two ends of the circular tube of the top joint 72, and the flange edge 722 resists against an annular surface 182 on an inner wall of the connection sleeve 18, while the limiting ring 723 resists against an outer surface of the top end of the cross rod 7, so that the top joint 72 can only rotate around the cross rod 7, the second end of the top joint 72 is provided with a mounting hole 724 for mounting to the hinge 8, the top joint 72 is connected to the hinge 8 by the match of a bolt 19 and a nut 20, the hinge 8 is capable of rotating around the bolt 19; the umbrella frame 9 has a cylinder 91 on the top, the cylinder 91 is inserted into the hinge 8 and fixed to the hinge 8 by screws; and the bottom joint 71 is connected to the sliding sleeve 3 and to the bottom end of the cross rod 7 by rivets.

When in use, holding the handle 10 with a right hand and pulling the handle 10 downward, the matching looped teeth 10.1 of the handle 10 are separated from the matching looped teeth of the clutch toothed sleeve 6, so that the clutch toothed sleeve 6 may rotate. Making the umbrella frame 9 to rotate left and right with a left hand to adjust the shading angle. After the right hand is released, the handle 10 moves upward for resetting under the action of the spring 13, and the matching looped teeth 10.1 of the handle 10 are engaged the matching looped teeth of the clutch toothed sleeve 6, so that positioning may be realized. Therefore, the operation is very simple and convenient.

The invention claimed is:

1. An adjustable umbrella, comprising:

an umbrella base;

a stand column fixed on the umbrella base, the stand column having a top;

a sliding sleeve slidably connected to the stand column;

a cross rod, movably connected to the sliding sleeve and slidable relative to the stand column, having a bottom end, a top end, and a bottom joint, the bottom joint being disposed on the bottom end of the cross rod;

an umbrella cover adjustment mechanism provided between the bottom joint and the bottom end of the cross rod;

the umbrella cover adjustment mechanism comprises a clutch toothed sleeve, a handle, and a first pin, the clutch toothed sleeve has an extension portion and an inner wall with a first annular recess, and the first pin has two ends;

the clutch toothed sleeve is rotatably sleeved outside of a lower portion of the cross rod and is limited in position by the handle, the first pin transversely passes through the cross rod and the two ends of the first pin are inserted into the first annular recess on the inner wall of the clutch toothed sleeve to position the clutch toothed sleeve relative to the cross rod;

a connecting hole is provided on the extension portion of the clutch toothed sleeve for receiving the bottom end of the elongated umbrella rib, and a protective jacket with a inserting hole for receiving the bottom end of the elongated umbrella rib when the elongated umbrella rib is inserted into the connecting hole;

a drawing rod having a first end and a second end, the first end of the drawing rod rotatably disposed on the top of the stand column, the second end of the drawing rod rotatably connected to the cross rod; and an umbrella frame with a top, wherein the top of the umbrella frame is rotatably attached to the top end of the cross rod through a rotating mechanism, the bottom joint of the cross rod is rotatably connected to the sliding sleeve, the umbrella frame has an elongated umbrella rib with a bottom end, the bottom end of the elongated umbrella rib is connected to the umbrella cover adjustment mechanism, the umbrella frame is rotatable by adjusting the umbrella cover adjustment mechanism.

2. The adjustable umbrella of claim 1, wherein the handle has an inner wall and slidably sleeves outside of the cross rod between the bottom end of the cross rod and the clutch toothed sleeve, at least one second pin transversely passes through the cross rod to limit movement of the handle, two circular grooves are formed on the inner wall of the handle for the two ends of the at least one second pin to insert in;

the clutch toothed sleeve and the handle each has an interface surface and both interface surfaces are provided with matching looped teeth;

a spring is disposed between the at least one second pin and a step formed on the inner wall of the handle adjacent to the clutch toothed sleeve, the spring is able to move the handle to engage the clutch toothed sleeve.

3. The adjustable umbrella of claim 1, wherein the rotating mechanism comprises a connection sleeve, a hinge, and a top joint, the hinge has a bottom, the top joint has a first end and a second end and is disposed on the top end of the cross rod, the connection sleeve is inserted into the top end of the cross rod, the first end of the top joint is rotatably inserted in the connection sleeve, the second end of the top joint is attached to the hinge, and the bottom of the hinge is connected to the top of the umbrella frame.

4. The adjustable umbrella of claim 3, wherein the connection sleeve has an external surface and two ends, the connection sleeve is provided with a second annular recess on the external surface, the two ends of the connection sleeve are provided with a plurality of small holes, a plurality of rivets transversely pass through the top end of the cross rod and insert into the small holes of the connection sleeve to fix the connection sleeve to the cross rod, one end of the connection sleeve is leveled with the top end of the cross rod after assembled.

5. The adjustable umbrella of claim 4, wherein the first end of the top joint is a circular tube for engaging the second annular recess of the connection sleeve, a flange edge and a limiting ring are respectively formed at the two ends of the circular tube of the top joint, and the flange edge resists against an annular surface on an inner wall of the connection sleeve, while the limiting ring resists against an outer surface of the top end of the cross rod, the second end of the top joint is provided with a mounting hole for mounting to the hinge.

6. The adjustable umbrella of claim 4, wherein the connection sleeve is composed of a pair of semicircle pieces, each semicircle piece is mounted in the cross rod by two rivets.

7. The adjustable umbrella of claim 3, wherein the umbrella frame has a cylinder on the top, the cylinder is inserted into the hinge and fixed to the hinge by screws.

8. The adjustable umbrella of claim 1, wherein the bottom joint is connected to the sliding sleeve and to the bottom end of the cross rod by rivets.

9. The adjustable umbrella of claim 1, wherein a top cover is provided on the top of the stand column, a connection piece sleeves outside of the cross rod for connecting the drawing rod, the first end and a second end of the drawing rod respectively are connected to the top cover and to the connection piece.

* * * * *